United States Patent [19]

Fantacone

[11] Patent Number: 4,938,375

[45] Date of Patent: Jul. 3, 1990

[54] DRINKING RECEPTACLE AND ICE TRAP

[76] Inventor: Ralph A. Fantacone, 104 Swan Pkwy. E., Royal Palm Beach, Fla. 33411

[21] Appl. No.: 303,271

[22] Filed: Jan. 30, 1989

[51] Int. Cl.[5] ..... B65D 23/00

[52] U.S. Cl. ..... 220/90.4; 210/464; 222/189

[58] Field of Search ..... 220/90.2, 90.4; 210/464, 469, 467; 222/189

[56] References Cited

U.S. PATENT DOCUMENTS

| | | | |
|---|---|---|---|
| 938,971 | 11/1909 | Cauffman et al. . | |
| 1,173,374 | 2/1916 | Nolda | 210/464 |
| 2,136,755 | 11/1988 | Prince | 210/464 |
| 2,357,063 | 8/1944 | Swing | 220/90.4 |
| 2,529,114 | 11/1950 | Tellier | 220/90.4 |
| 2,744,631 | 5/1956 | Toombs | 220/90.4 |
| 2,753,050 | 7/1956 | Langston | 220/90.2 |
| 3,184,126 | 5/1965 | Casull | 220/90.2 |
| 3,326,401 | 6/1967 | DeLong | 215/38 |
| 3,717,276 | 2/1973 | Richie et al. | 215/40 |
| 4,006,557 | 2/1977 | Sawyer | 47/61 |
| 4,508,235 | 4/1985 | Steele et al. | 215/307 |

FOREIGN PATENT DOCUMENTS

| | | |
|---|---|---|
| 577569 | 9/1924 | France . |
| 606908 | 6/1926 | France . |

*Primary Examiner*—Donald F. Norton

[57] ABSTRACT

The Ice Trap comprises a trapping device and beverage cup combination, the trapping device having a plurality of openings, a conical shaped side section, a rim, compresssion gap, and compressión tabs for inserting, locking in, and removing the device, and also having a bottom section with a downward pitch for ice containment near the inner cup wall when tilted, and a center bottom opening in the bottom section for the insertion of a straw; a beverage cup having an internal annular lip formed from the inwardly sloping wall, and a annular horizontal bottom surface included beneath the lip for locking the device in place.

2 Claims, 2 Drawing Sheets

DRINKING RECEPTACLE AND ICE TRAP

FIELD OF INVENTION

This invention relates to drinking cups for iced beverages and more particularly to a specifically constructed ice trapping device inserted into the beverage cup to retain the ice while drinking.

BACKGROUND OF THE INVENTION

A stop at any one of the many fast food restaurants across our country could be made more enjoyable if a person did not have to fight the ice in their cold drinks. For many people, it can be most annoying when trying to get a good-sized gulp of refreshing drink. A straw does not allow enough liquid refreshment to pass through to give that satisfaction looked for in any drink. Ice can also be a nuisance to sensitive teeth and lips as well as promote spillage as the ice falls forward from a tipped cup.

It would be very helpful and pleasurable if some device were available to block the ice inside the cup allowing one to drink a good-sized gulp without accident, inconvenience, or discomfort. It would also be appreciated if there were no added cost to the beverage with such a device, nor detraction from the overall appetizing appearance of the beverage drink.

Inventors have created various forms of ice retaining devices or strainers to accommodate this need or similar need. One such device is available which is disclosed in U.S. Pat. No. 4,508,235 to Steele (1985, Apr. 2). This hemispherically-shaped cover includes a top opening for receiving the beverage. The cover itself inhibits spillage of the beverage over the rim of the cup due to the foaming action of the beverage and yet still allows the straw to be used through the opening for drinking. However, it has limitations since a straw is a necessary part of its function.

Other such types of devices which have been designed are disclosed in U.S. Pat. No. 1,173,374 to Nolda (1916, Feb. 29), 2,357,063 to Swing (1944, Aug. 29), and 2,744,631 to Toombs (1956, May 8). They require clamps or clips to insert and remove the device or hold it in place within the drinking glass or vessel. Also, the devices are designed for retaining large chunks or cubes of ice or for straining the liquid, except for the ice guard of U.S. Pat. No. 2,357,063 to Swing which is mentioned above. These particular designs cannot contain the ice near the inner cup wall keeping it from suddenly falling forward splashing the beverage through the device. Nolda mentioned above shows the device with a conically-shaped resilient ring with a slit which has to be inserted and removed from the beverage glass with prongs which is inconvenient to the user. None show the device as having a side section like that of the present invention having a plurality of openings for the beverage to flow through.

The inventions disclosed in U.S. Pat. Nos. 2,753,050 to Langston (1956, July 3) and 2,136,755 to Prince (1938, Nov. 15) show a trapping means or guard for retaining only large cubes or chunks of ice or fruits and which do not provide an easy, convenient, and dependable way to insert the device correctly or in its removal. These inventions are not easy and economical to manufacture in comparison to the present invention.

The materials suggested to be used in making these devices are varied, but a transparent material is not suggested to make the device unobvious and non-distracting within the beverage glass or vessel.

Several types of drinking vessels have been designed as in U.S. Pat. Nos. 3,184,126 to Casull (1965, May 18) which has a flow control valve to prevent spillage, and 2,529,114 to Tellier (1950, Nov. 7) which provides a safety cup and cap designed to facilitate drinking and yet prevent spillage. Both of these designs feature elements for controlling the flow of the beverage and not for retaining the ice.

Other types of drinking vessels as in U.S. Pat. Nos. 2,136,755 to Prince and 2,753,050 to Langston show annular grooves or bulges designed to accommodate a trapping device but they do not provide an easy, operative means for inserting and removing the device. They also fail in locking the device securely in place.

With the foregoing in mind, the present invention provides an easy, convenient, and dependable way to insert and remove the ice trapping device and still be very functional in performing completely its purpose, and yet still provide an unobvious, non-distracting, and appealing way to drink iced beverages without accident, or ice blocking up against the mouth and teeth.

BRIEF DESCRIPTION OF THE INVENTION

More particularly in its broadest aspect, the ice trap is a blocking device and a specially designed cup combination. When inserted into the cup opening and locked into position, the ice trapping device allows a person to tip the cup to drink without spillage due to the ice suddenly falling forward. The device also has a bottom opening. This center opening is of sufficient size so that a straw may be inserted to permit a person to drink the beverage without having to remove the device.

OBJECTS AND ADVANTAGES

It is therefore a general object of this invention to provide an economical, satisfactory, convenient means of drinking an iced beverage with no discomforts or accidents.

The object of this invention is to provide a means by which a person can enjoy any iced liquid beverage without the use of a straw and/or a cover of any kind, and yet provide a center bottom opening in the ice trapping device for a straw if still preferred.

Yet another object of the invention is to provide an ice trapping device with a downward pitch in the bottom section keeping ice contained near the inner cup wall so the ice will not fall suddenly forward damming up across the bottom and splashing the beverage.

A further object of this invention is to provide an ice trapping device for iced beverages with a conical shaped side section, a rim, compression gap, and compression tabs providing an easy, convenient, and dependable way for insertion and removal, and locking the device easily, securely, and correctly in place.

Another object of this invention is to provide a trapping device with a means for retaining all forms and sizes of ice, but allows the beverage to flow smoothly toward the rim of the cup.

Further objects and advantages of the invention will become apparent from a consideration of the drawings and ensuing description of it.

LIST OF NUMERALS

Figure 1:
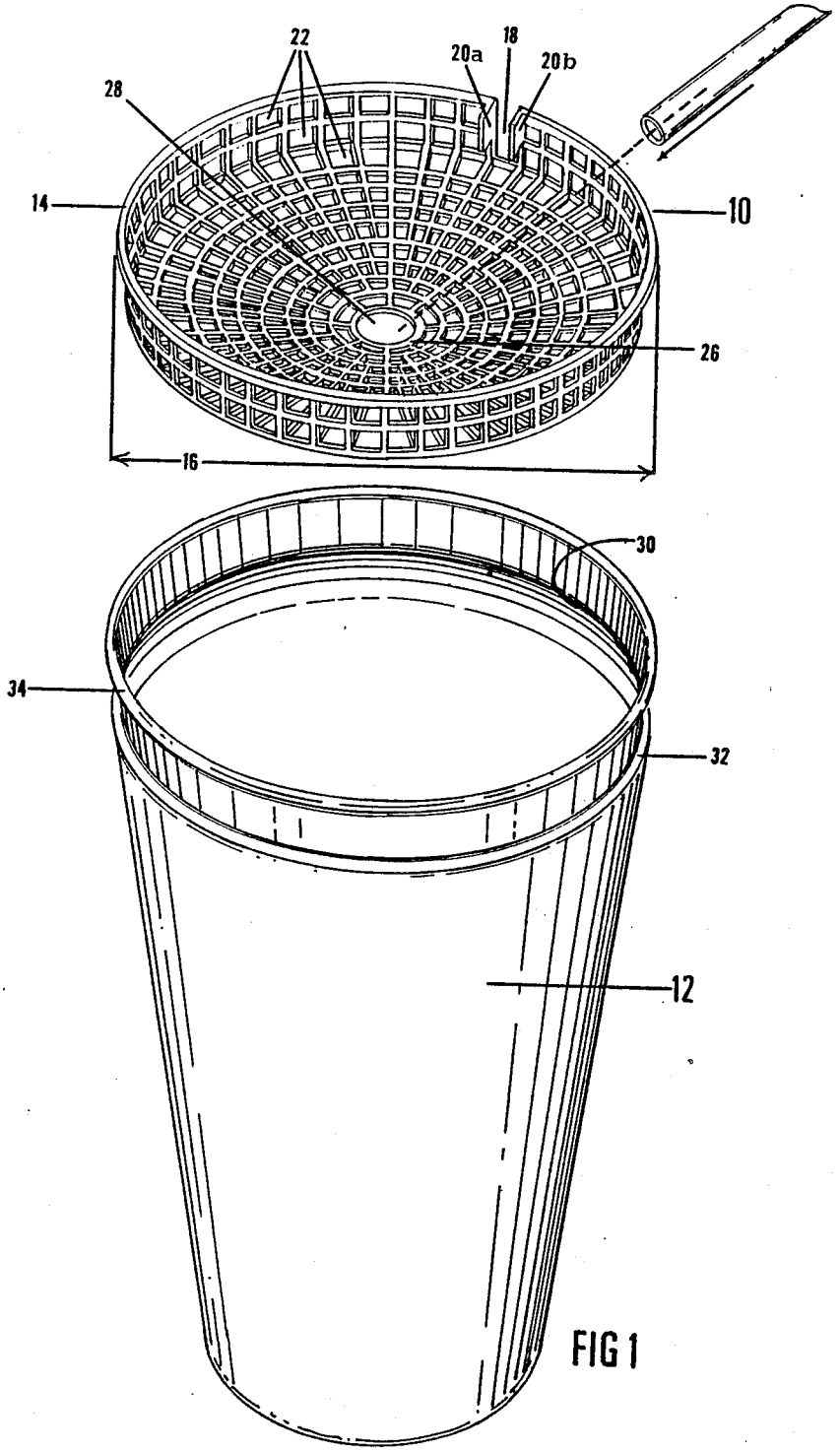
FIG. 1 shows a perspective view of the trapping device preparatory to being inserted into the beverage cup and straw is readied for insertion

10. ice trapping device
12. beverage cup
14. device rim
16. device top opening
18. device compression gap
20. afferent compression tabs a and b
22. plurality of openings
24. device side section
26. device bottom section
28. device center bottom opening
30. internal annular lip
32. annular horizontal bottom surface
34. cup rim

DESCRIPTION OF THE INVENTION

Referring to FIG. 1 shown in the ice trapping device 10 and beverage cup 12 in a perspective view and constructed according to the preferred embodiment of this invention.

In FIG. 1 the inner cup 12 wall is shown sloping inwardly down from the cup rim 34 forming an internal annular lip 30 and includes the annular horizontal bottom surface 32 positioned therebeneath approximately ½ inch down from the cup rim 34 and being approximately 3/16 of an inch in width. The upper portion of the cup 12 wall above the annular horizontal bottom surface 32 is angled to follow the lower portion therebeneath. The significance of this annular horizontal bottom surface 32 is to lock the device securely in place.

In the preferred embodiment, the cup 12 is formed of materials such as plastic, plastic or wax-coated paper, or styrofoam constituting a throwaway item.

Figure 2:
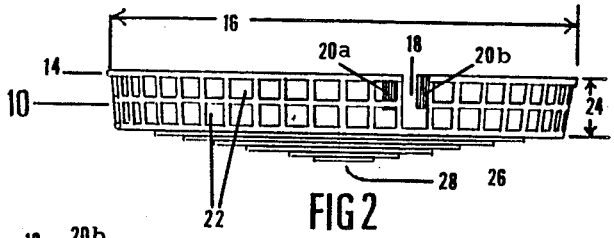
FIG. 2 shows a side view of the ice trapping device of FIG. 1.

Referring to FIG. 2, the device 10 is circular in shape conforming to the shape of the cup 12 and is preferably molded from a resilient material for added flexibility, and the resilient material being transparent. The device top opening 16 at the rim 14 is close in diameter to the inside diameter of the cup 12 below the annular horizontal bottom surface 32 providing a close fit to the inner cup 12 wall when locked in position. The device 10 further includes the side section 24 which is conical shaped conforming to the angle of the cup 12 wall, and is approximately ½ inch in depth.

Figure 3:
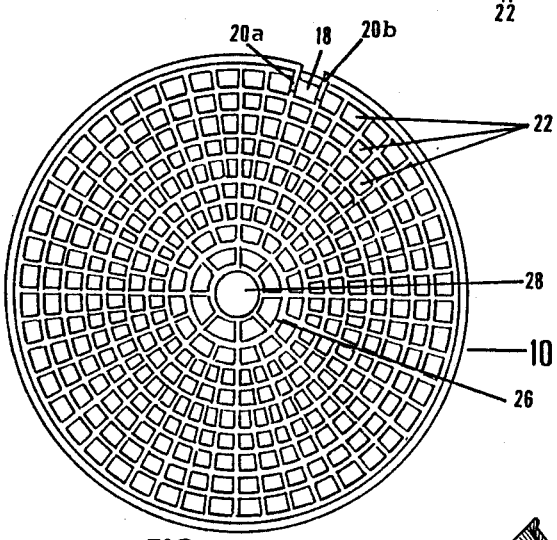
FIG. 3 shows an aerial view of FIG. 2.

FIG. 2 also shows the device bottom section 26 directed downward at a 7 degree pitch from the perimeter to the center and the diameter is less than the diameter of the device top opening at the rim 14. In FIG. 2 and FIG. 3, shown is the device side section 24 and the device bottom section 26 having a plurality of openings 22 formed from the gridlike pattern of intersecting vertical and horizontal solid line sections and they begin at the device rim 14 therebeneath and extend to the center of the bottom section 26. These openings 22 are rectangular in shape, are less than ½ inch in length and depth, and follow concentrically with the circular shape of the device 10. They are adjacent and parallel to one another decreasing in length past the perimeter of the device bottom section 26 to the center bottom opening 28. Note particularly that the plurality of openings 22 in the side section 24 contribute to a smooth flow of the beverage.

Figure 5:
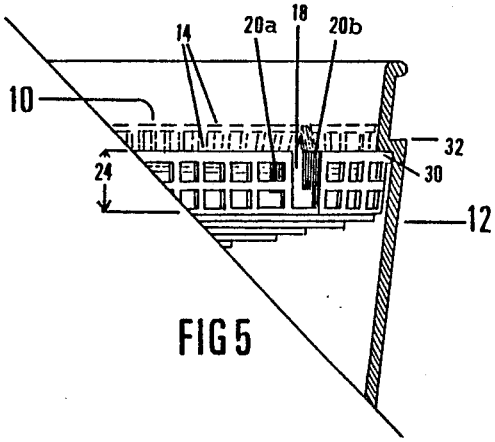
FIG. 5 is an enlarged fragmentary cross-section taken in direction of the arrows 5—5 of FIG. 4.

Referring particularly to FIG. 5, it will be noted that the device rim 14 is equal or near equal in width with that of the annular horizontal bottom surface 32 allowing the device 10 to lock in therebeneath. A deleted portion in the form of a compression gap 18 is provided in the device side section 24 and it has two afferent compression tabs indicated at 20*a* and *b* which are located at each vertical side thereof where the rim 14 and the device side section 24 ends. The compression tabs 20*a* and *b* are equally substantial in length for grasping in removing the device 10 and they extend from the device rim 14 downward approxiamtely ¾ths the depth of the compression gap 18. The compression gap 18 is the depth of the device side section 24 starting at the device rim 14 and is of a width that provides the degree of flexibility needed.

Referring to FIG. 3, the device bottom section 26 has a center bottom opening 28. This opening has a diameter of less than ½ the diameter of the device bottom section 26 for accommodating a straw of preferred.

OPERATION OF THE INVENTION

Figure 4:
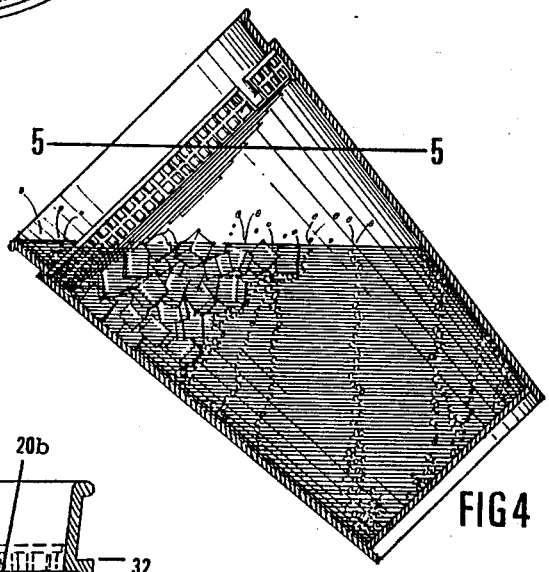
FIG. 4 shows another view of the trapping device and beverage cup with the ice and beverage.

To make the Ice Trap of FIG. 1 functional, the trapping device 10 is inserted into the beverage cup 12 as shown in FIG. 4. The foregoing action can be best visualized by referring to the drawing of FIG. 5 which shows the device 10 locked in position therebeneath the annular horizontal bottom surface 32 of the cup 12. When inserted and pushed past the cup rim 34, a slight contraction occurs in the device compression gap 18 and the device rim 14. As the device rim 14 passes the internal annular lip 30 reaching the annular horizontal bottom surface 32 therebeneath, the device rim 14 and the compression gap 18 spring back to a relaxed position locking the device 10 in place and fitting the device side section 24 closely to the inner cup 12 wall thus allowing the beverage to flow smoothly through and past the device 10. It will be appreciated that the distance of the annular horizontal bottom surface 32 from the cup rim 34 allows easy access to the compression tabs 20*a* and *b* for removal of the device 10. It will also be appreciated that the conical shape of the side section 24 conforms to the angle of the cup 12 wall allowing the device 10 to enter parallel to the cup rim 34 and remain in this parallel position as it locks correctly in place therebeneath the annular horizontal bottom surface 32. The depth of the side section 24 contributes further to retaining the ice further from the cup rim 34 but still allows the compression tabs 20*a* and *b* to be accessible. The downward pitch of the device bottom section 26 serves the purpose of containing the ice near the inner cup 12 wall so it will not fall suddenly forward damming up across the device bottom, of providing additional strength, and as the ice pushes against the bottom, the pressure pushes the side section 24 closer to the inner cup 12 wall. The containment of the ice and the pitch further contributes to the smooth flow of the beverage. In the device bottom section 26, there is a center bottom opening 28 for receiving a drinking straw so the user can drink without having to remove the device 10.

As shown in FIG. 2 and FIG. 3, the plurality of openings 22 of the device side section 24 and the device bottom section 26 allows a free flowing beverage as the device 10 itself blocks all forms and sizes of ice from the user's mouth. Further, the plurality of openings 22 prevent the beverage from splashing through the device onto the user if the cup is tilted too far.

Referring again to the fragmentary drawings of FIG. 5, it will be noted that the device side section 24 includes the rim 14 and the compression gap 18 having two afferent compression tabs 20*a* and *b*. To remove the device 10 from the cup 12, the user squeezes the compression tabs 20*a* and *b* causing a contraction of the compression gap 18 and the device rim 14 decreasing the diameter of the device top opening 16. This contraction allows the device rim 14 to pass the internal annular lip 30 as the device 10 is being lifted and removed. The resiliency of the material of the device 10 adds to the functionality in the insertion and removal. This device 10 can also be removed for additional ice. It will be appreciated that the resilient material is transparent which allows the device 10 to blend itself with the cup 12 interior so as not to be obvious and distracting.

SUMMARY AND SCOPE

Accordingly, the reader will see that this invention comprises a beverage cup and ice trapping device providing a highly convenient, easy, and functional way to drink iced beverages without accident of spillage or without fighting the ice.

It provides a trapping device which can be inserted and removed without awkward attachments to perform this function or to hold it securely in place.

If the cup is tilted too far causing the ice to fall forward against the device, the gridlike pattern and small plurality of openings in the devices keep the beverage from splashing through the device.

It allows all forms and sizes of ice to be used and yet the beverage will flow smoothly toward the cup rim.

It provides a trapping device designed with a downward pitch in the bottom section highly functional in containment of the ice near the inner cup wall keeping it from damming across the bottom or falling forward splashing the beverage.

It provides a trapping device whose structure is formed of a transparent material so it will not be obvious and distracting within the cup.

It provides a drinking cup which has a annular horizontal bottom surface for locking the device within securely and easily, but the device can still be removed easily if necessary.

It can be easily and cheaply manufactured since the beverage cup and the trapping device are separate units, each being formed from one mold.

It provides a trapping device with a conical shaped side section making it possible for the device to enter the cup parallel to the cup rim and remain in a parallel position as it locks in place therebeneath the annular horizontal bottom surface.

From all the foregoing, it will be evident that the present invention has provided a unique and useful beverage cup and ice trapping device providing a more enjoyable and statisfying way to drink iced beverages without adding to the cost of the beverage or detracting from the overall appetizing appearance of the beverage.

In the preferred embodiment, as described, the cup is made from plastic, waxed or plastic coated paper, or styrofoam and the ice trapping device is made of a resilient transparent material, thus both can be economically manufactured and constitute a disposable item when a person is finished drinking.

While the description contains many specifications of the preferred embodiment, the reader should not construe these as limitations of the scope of the invention, but merely exemplifications of the preferred embodiment. Many other variations are possible. For example, skilled artisans will readily be able to change the color, size, pitch, and shape in variations and modifications of the invention providing opportunities to broaden or expand potential uses or applications of it. For example, if fast food restaurants are to use the ice trap, it can accommodate the range of container sizes currently available making the transition to the trap simplified significantly. Size variations of the ice trap to conform to an older paper cup style that may be resurrected would be less expensive than retooling a design change for present drinking cups.

Although the ice trap was designed for throwaways, the stainless steel ice trapping device could be used with drinking glasses as well as service pitchers. As in the preferred embodiment, compression tabs and the compression gap are incorporated into the side of the trapping device by which it may be lifted out to replace melting ice, if necessary. Replacement trapping devices could be sold separately for home use with plastic cups designed for its use. The ice trap will be made of materials that are available and easily obtained.

I claim:

1. In combination, a drinking receptacle and an ice trap comprising:

(a) a beverage cup having a rim defining a circular top opening, a substantially conical side wall sloping downwardly and inwardly toward a bottom well and an internal annular lip in the sloping side wall with said lip having an annular, horizontal bottom surface and, (b) a flexible ice trap, said ice trap being formed of resilient material, said ice trap comprising a circular rim defining a top opening close in diameter to the inside diameter of the cup side wall just below the bottom surface of said lip, said trap having a conical side section conforming to the angle of said cup wall and a bottom section sloping downwardly and inwardly from the bottom of said side section, (c) said trap rim and side section comprising flexible means for contracting when pressed downwardly against said lip upon insertion into said cup and for springing back toward a relaxed position beneath said lip bottom surface to lock said trap in said cup, (d) said trap having a plurality of openings concentrically arranged in said side and bottom sections, said openings extending from said trap rim to the center of said bottom section, (e) whereby when locked into position beneath said lip bottom surface said trap allows beverage to flow smoothly through said openings while retaining pieces of ice in said cup.

2. A drinking receptacle and ice trap as defined in claim 1 wherein, said ice trap having an opening positioned in said sloping bottom section, said bottom opening being of sufficient width for accommodating a straw.

* * * * *